United States Patent [19]

Karrenbauer et al.

[11] 4,236,054

[45] Nov. 25, 1980

[54] GAS-BLAST CIRCUIT BREAKER

[75] Inventors: Herbert Karrenbauer, Niestetal; Karl Ahrens, Kassel, both of Fed. Rep. of Germany

[73] Assignee: Licentia Patent-Verwaltungs-G.m.b.H., Frankfurt am Main, Fed. Rep. of Germany

[21] Appl. No.: 930,324

[22] Filed: Aug. 2, 1978

[30] Foreign Application Priority Data

Aug. 12, 1977 [DE] Fed. Rep. of Germany ..... 2736392

[51] Int. Cl.[3] ..... H01H 9/40

[52] U.S. Cl. ..... 200/145; 200/148 A

[58] Field of Search ..... 200/148 R, 148 A, 148 B, 200/148 C, 148 D, 148 E, 148 F, 148 G, 148 H, 148 J, 148 BV, 150 G, 145

[56] References Cited

U.S. PATENT DOCUMENTS

| | | | |
|---|---|---|---|
| 2,913,556 | 11/1959 | Leeds | 200/148 A X |
| 3,769,479 | 10/1973 | Leeds | 200/148 A |
| 3,895,202 | 7/1975 | Okerman et al. | 200/148 A |
| 3,939,317 | 2/1976 | Noack et al. | 200/148 A |
| 4,105,880 | 8/1978 | Rapp et al. | 200/148 A |

*Primary Examiner*—Gene Z. Rubinson
*Assistant Examiner*—Morris Ginsburg
*Attorney, Agent, or Firm*—Spencer & Kaye

[57] ABSTRACT

A gas-blast circuit breaker has a plurality of serially arranged circuit breaking stations per pole and a tubular throughgoing stationary casing of electrically insulating material enclosing the circuit breaking stations. Each circuit breaking station has a stationary contact affixed to the casing, a movable contact cooperating with the stationary contact, a movable nozzle of insulating material and a gas pressurizing piston-and-cylinder arrangement. Each such arrangement has an outer cylindrical wall structure, a piston slidable therein and a stationary component affixed to the casing and forming a radial cylinder base. Each outer cylindrical wall structure is constituted by a length portion of the casing. Each piston-and-cylinder arrangement has an inner wall structure spaced from the casing. The inner wall structures each constitute a guide for slidably supporting the movable contact for axial displacement with respect to the inner wall structure.

7 Claims, 2 Drawing Figures

GAS-BLAST CIRCUIT BREAKER

BACKGROUND OF THE INVENTION

This invention relates to a gas-blast circuit breaker having a plurality of serially arranged circuit breaking stations per pole. Each circuit breaking station has a gas-compressing arrangement formed of a piston-and-cylinder assembly, a movable contact, a stationary counter contact, as well as a movable nozzle of insulating material.

A gas-blast circuit breaker having, for the arc-extinguishing gas, a compressing arrangement formed of a stationary piston and a movable cylinder is described, for example, in U.S. Pat. application Ser. No. 881,719, now U.S. Pat. No. 4,211,904, issued July 8, 1980. During the circuit breaking operation, the cylinder is moved with respect to the stationary piston and thus the extinguishing gas in the compression chamber is compressed. In case such a circuit breaker is to be installed in a grounded metal housing, for the purpose of protecting the metal walls against arcs, the circuit breaker has to be additionally surrounded by a tube made of an insulating material. Such an insulating tube may also be needed in case a plurality of serially arranged circuit breaking stations per pole are provided, as described, for example, in U.S. Pat. application Ser. No. 758,870, now U.S. Pat. No. 4,105,880. In this circuit breaker structure, the insulating tube serves for the support of the stationary components of the circuit breaking stations.

SUMMARY OF THE INVENTION

It is an object of the invention to provide an improved gas-blast circuit breaker of the above-outlined type which has a simplified structure.

This object and others to become apparent as the specification progresses, are accomplished by the invention, according to which, briefly stated, the gas-blast circuit breaker has a plurality of serially arranged circuit breaking stations per pole; and a tubular throughgoing stationary casing of electrically insulating material enclosing the circuit breaking stations. Each circuit breaking station has a stationary contact affixed to the casing, a movable contact cooperating with the stationary contact, a movable nozzle of insulating material and a gas pressurizing piston-and-cylinder arrangement. Each such arrangement has an outer cylindrical wall structure, a piston slidable therein and a stationary component affixed to the casing and forming a radial cylinder base. Each outer cylindrical wall structure is constituted by a length portion of the casing. Each piston-and-cylinder arrangement has an inner wall structure spaced from the casing. The inner wall structures each constitute a guide for slidably supporting the movable contact for axial displacement with respect to the inner wall structure.

DESCRIPTION OF THE PREFERRED EMBODIMENT

Figure 1:
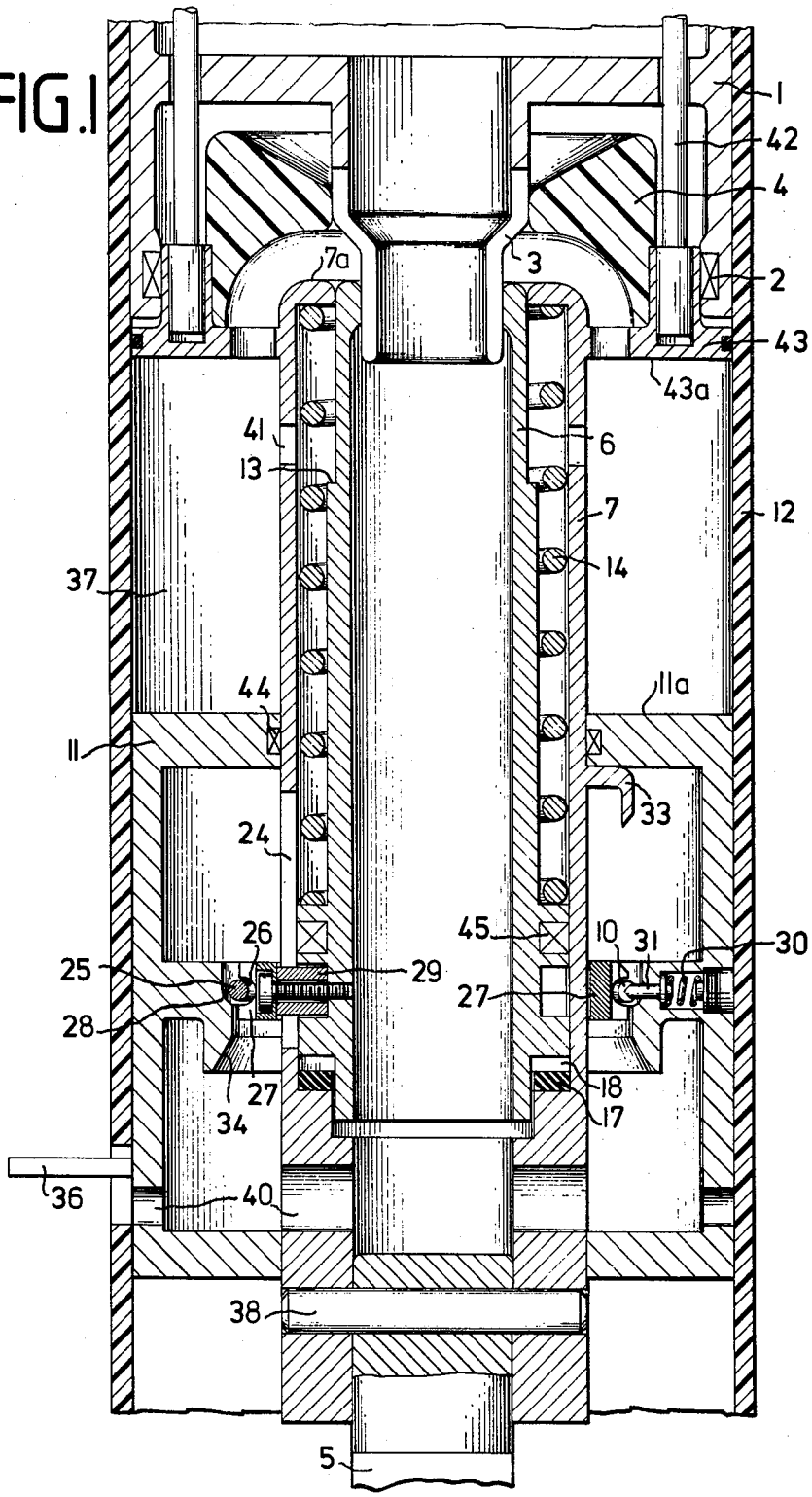
FIG. 1 is a fragmentary longitudinal sectional view of a preferred embodiment of the invention, illustrating a single circuit breaking station.

The circuit breaker according to the invention is a circuit breaker column formed of a plurality of superposed circuit breaking stations of a switch pole. The circuit breaking stations are arranged serially on top of one another and are accommodated within a throughgoing, fixed tubular casing 12 which is made of an insulating material. FIG. 1 illustrates the lowermost circuit breaking station; its structure and operation are identical to the other circuit breaking stations, not illustrated in detail. The non-moving components of each circuit breaking station, such as the counter contact 1, formed of a nominal contact 2 and a power contact 3 as well as a stationary component 11, together with a locking device 10 arranged on the piston 11 are affixed (for example, by means of a screw connection) to the inner wall of the throughgoing tubular casing 12.

The movable components of each circuit breaking station comprise a nozzle 4 of insulating material, a guide sleeve 7 having a piston member (piston flange) 43 and actuating rods 42 secured to the nozzle 4. The actuating rods 42 are attached to the guide sleeve 7 of the immediately superposed circuit breaking station. The guide sleeve 7 of the illustrated lowermost circuit breaking station is connected to a circuit breaker actuator drive (not shown) by means of a bar 5 and a pin 38. Thus, when the actuator drive exerts a force through the bar 5 to the lowermost guide sleeve 7, the guide sleeves of all the circuit breaking stations will move in unison by virtue of the connecting bars 42.

Each circuit breaking station further has a movable power contact 6 which is axially displaceably supported within and with respect to the guide sleeve 7. The movable contact 6 is biased by a spring 14 and may be locked to the stationary component 11 by means of a locking device 10 in its circuit making state, that is, when it is in engagement with the stationary power contact 3.

The lower current terminal 36 of the circuit breaker is affixed to the stationary component 11 of the lower most circuit breaking station. From the terminal 36, the current path leads through a first annular contact 44 in the stationary component 11 and a second annular contact 45 to the movable power contact 6 and therefrom the current path continues through the stationary counter contact 1 which is formed of the power contact 3 and the nominal current contact 2. The upper current terminal (not shown in FIG. 1) of the switch pole is connected to the stationary contact 1 of the uppermost circuit breaking station.

Each circuit breaking station further includes an annular compression chamber 37 which is defined by the cylindrical outer face of the guide sleeve 7, the cylindrical inner face of the casing 12, the upper radial face **11*a* of the stationary component 11 (forming the cylinder base) and the lower radial face 43*a* of the flange piston 43 forming part of the guide sleeve 7. The compression chamber 37** contains an arc extinguishing gas which is pressurized during the circuit breaking operation in a manner described below.

For initiating the circuit breaking operation, the bar 5 is pulled downwardly from its illustrated position. This causes, in each circuit breaking station, downward movement of the guide sleeve 7, the nozzle 4 and the movable nominal current contact which thus separates from the stationary nominal current contact 2. The movable power contact 6 remains in the connected state, since at this time, it is maintained in engagement with the stationary power contact 3 by means of the locking device 10. As the guide sleeve 7 moves away from the stationary contact 3 (that is, downwardly, as shown in FIG. 1), the spring 14 is compressed. Simultaneously, the extinguishing gas present in the compression chamber 37 is pressurized as the flange piston 43 moves towards the stationary piston component 11, thus reducing the volume of the chamber 37. For radial resiliency the stationary power contact 3 is segmented; the segments are separated by very narrow axial slits, so that a premature escape of the extinguishing gas is prevented.

As soon as the radially inwardly oriented rim 7a of the guide sleeve 7 abuts the radially outwardly oriented circumferential shoulder 13 of the movable power contact 6, the latter is released from the locking device 10 by an axially oriented chamferred pin 33 affixed to the guide sleeve 7.

The locking device 10 is known by itself and is described in German Pat. No. 1,540,062 as a "piston ring lock". It comprises a piston ring (split ring) 25 disposed in an annular groove 26 of a carrier ring 27 and engages, in the locked state, an annular face 28 of the stationary component 11. The carrier ring 27 is secured to a plurality of pins 29 circumferentially distributed on the movable power contact 6. The pins 29 project into the guide sleeve 7 through longitudinal slots 24 provided in the guide sleeve 7. A radially oriented pin 31 biased by a compression spring 30 serves for supporting the split ring 25 in its locked position.

As soon as the pin 31 is pressed radially inwardly by the camming action of the axially oriented pin 33 secured to the guide sleeve 7, the split ring 25 is pressed into the groove 26 of the carrier ring 27 by means of the chamferred annular face 28 and thus the movable power contact 6 is unlatched. As a result, the armed spring 14 accelerates the power contact 6 away from the stationary power contact 3 into an end position where it is dampened by a gas cushion 18 and a synethic gasket 17.

The arc drawn by virtue of the separation of the contact 6 from the contact 3 is blasted and blown out by the gas which was compressed earlier in the chamber 37 and which now finds a flow path between the separated contacts 3 and 6. The gas then flows through the hollow power contacts 3 and 6 as well as through the lateral bores 40 provided in the lower part of the guide sleeve 7 and the stationary component 11.

Instead of the compression spring 14 or in addition thereto, the contact 6 may be accelerated away from the stationary contact 3 by means of the compressed gas. For such a purpose, the annular chamber between the guide sleeve 7 and the power contact 6 is connected with the upper portion of the compression chamber 37 by means of ports 41 provided in the guide sleeve 7.

During the closing movement of the circuit breaker, the split ring 25 is, during the upward motion of the guide sleeve 7, compressed by an oblique annular surface 34 provided on the stationary component 11 and is again brought into its position illustrated in FIG. 1.

Figure 2:
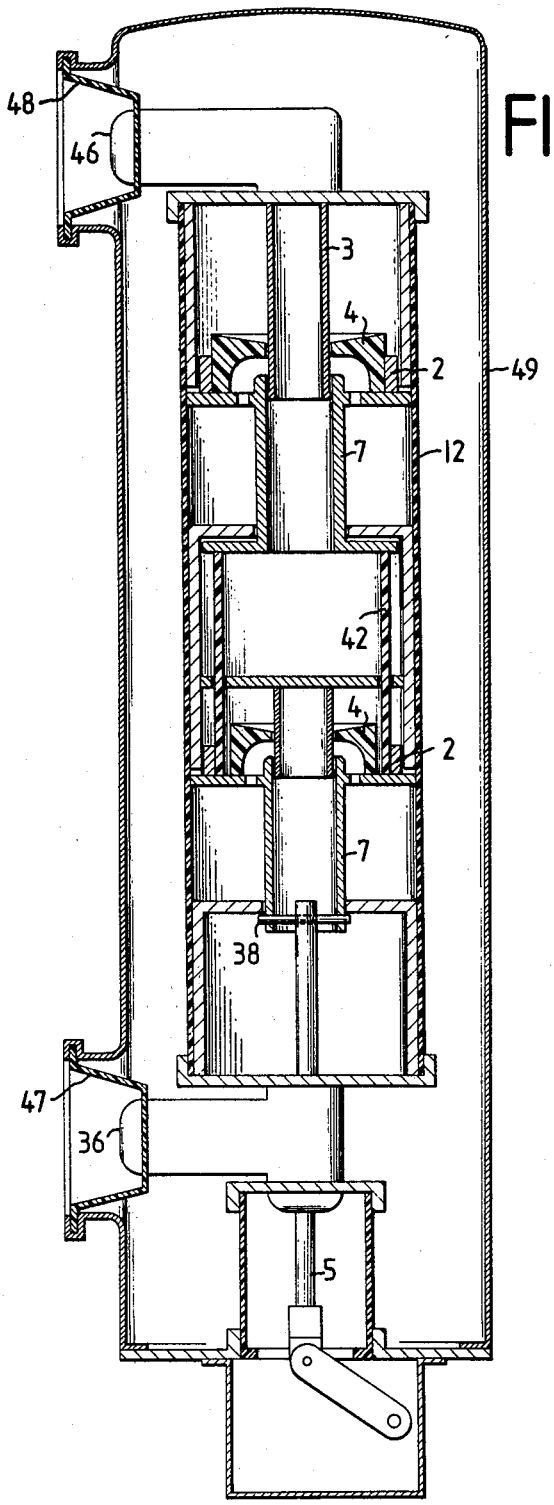
FIG. 2 is a longitudinal sectional view of the same embodiment, illustrating an entire circuit breaker pole with two circuit breaking stations.

Turning now to FIG. 2, there is shown an entire circuit breaker pole having two superposed circuit breaking stations which, as noted earlier, are accommodated in the throughgoing casing 12. The entire structure is positioned within a metal housing 49. The lower electric terminal 36 and the upper electric terminal 46 are supported by respective funnel-shaped insulators 47 and 48 mounted in the housing 49. For the sake of clarity a number of components shown in FIG. 1 are omitted from FIG. 2.

It is to be understood that the above description of the present invention is susceptible to various modifications, changes and adaptations, and the same are intended to be comprehended within the meaning and range of equivalents of the appended claims.

What is claimed is:

1. In a gas-blast circuit breaker having a plurality of serially arranged circuit breaking stations per pole; a tubular throughgoing stationary casing of electrically insulating material enclosing the circuit breaking stations; each circuit breaking station having a stationary contact affixed to said casing, a movable contact cooperating with the stationary contact, a movable nozzle of insulating material and a gas pressurizing piston-and-cylinder arrangement each having an outer cylindrical wall structure, a piston slidable therein and a stationary component affixed to said casing and forming a radial cylinder base; the improvement wherein each said outer cylindrical wall structure is constituted by a length portion of said casing and further wherein each piston-and-cylinder arrangement has an inner wall structure spaced from said casing; each said inner wall structure constituting a guide for slidably supporting said movable contact for axial displacement with respect to said inner wall structure.

2. A gas-blast circuit breaker as defined in claim 1, wherein said piston is constituted by a circumferential flange member forming an integral part of said guide and projecting outwardly therefrom.

3. A gas-blast circuit breaker as defined in claim 1, further comprising actuator rods of insulating material rigidly connecting the guides of adjoining stations with one another for effecting a unison displacement of the guides of all said stations upon actuation of the circuit breaker.

4. A gas-blast circuit breaker as defined in claim 3, wherein each nozzle is affixed to the guide of the respective station, and further wherein opposite ends of each actuator rod between two adjoining stations are attached to the nozzle of the one station and to the guide of the other station.

5. A gas-blast circuit breaker as defined in claim 1, wherein each said inner wall structure has a sleeve-like configuration to constitute a guide sleeve within which it slidably supports said movable contact.

6. A gas-blast circuit breaker as defined in claim 5, further comprising a spring disposed within said guide sleeve of each station and engaging the guide sleeve and the movable contact for urging said movable contact away from said stationary contact.

7. A gas-blast circuit breaker as defined in claim 5, wherein each outer cylindrical wall structure, each respective said inner wall structure, each respective said cylinder base and each respective said piston together define a compression chamber, and further wherein said guide sleeve has openings for maintaining communication between said compression chamber and the inside of said guide sleeve for urging said movable contact away from said stationary contact by a gas compressed in said compression chamber.

* * * * *